US005652086A

United States Patent [19]

Brayer et al.

[11] Patent Number: 5,652,086

[45] Date of Patent: Jul. 29, 1997

[54] PROCESSING RADIOGRAPHIC FILMS WITH LOW DEVELOPER REPLENISHMENT USING AN ALKALINE REPLENISHING SOLUTION

[75] Inventors: Franklin Charles Brayer, Rochester; Robert Edward Dickerson, Hamlin; Stephen Alan Hershey, Fairport; Patrick Michael Jeffries, Pittsford, all of N.Y.

[73] Assignee: Eastman Kodak Company, Rochester, N.Y.

[21] Appl. No.: 639,339

[22] Filed: Apr. 26, 1996

[51] Int. Cl.[6] ..... G03C 5/31

[52] U.S. Cl. ..... 430/398; 430/399; 430/445; 430/448; 430/487

[58] Field of Search ..... 430/398, 399, 430/445, 448, 487

[56] References Cited

U.S. PATENT DOCUMENTS

| | | | |
|---|---|---|---|
| 5,229,248 | 7/1993 | Sanpei et al. | 430/264 |
| 5,382,496 | 1/1995 | Sakai et al. | 430/264 |
| 5,474,879 | 12/1995 | Fitterman et al. | 430/445 |
| 5,578,414 | 11/1996 | Yamamoto et al. | 430/264 |

*Primary Examiner*—Hoa Van Le

*Attorney, Agent, or Firm*—J. Lanny Tucker

[57] ABSTRACT

Radiographic films can be processed using conventional developing agents, either in the films or in solution. The films also include from about 0.02 to about 1 mg/dm$^2$ of thialkylene bis(ammonium salt). The solution used for development is replenished at a low rate with a chemical base as the sole developer replenishing agent. The chemical base maintains developer composition pH at from about 9 to about 11 and enables processing of films without the use of conventional developer replenishing solutions or replenishment rates.

20 Claims, No Drawings

PROCESSING RADIOGRAPHIC FILMS WITH LOW DEVELOPER REPLENISHMENT USING AN ALKALINE REPLENISHING SOLUTION

FIELD OF THE INVENTION

This invention relates to a photographic processing method whereby imagewise exposed silver halide radiographic films are developed using a chemical base as the sole replenishing reagent in an alkaline replenishing solution.

BACKGROUND OF THE INVENTION

Roentgen discovered X-radiation by the inadvertent exposure of a silver halide photographic element. In 1913 the Eastman Kodak Company introduced its first product specifically intended to be exposed by X-radiation. Silver halide radiographic elements account for the overwhelming majority of medical diagnostic images.

In recent years a number of alternative approaches to medical diagnostic imaging, particularly image acquisition, have become prominent. Medical diagnostic devices such as storage phosphor screens, CAT scanners, magnetic resonance imagers (MRI), and ultrasound imagers allow information to be obtained and stored in digital form. Although digitally stored images can be viewed and manipulated on a cathode ray tube (CRT) monitor, a hard copy of the image is almost always needed.

The most common approach for creating a hard copy of a digitally stored image is to expoe a radiation-sensitive silver halide film through a series of laterally offset exposures using a laser, a light emitting diode (LED) or a light bar (a linear series of independently addressable LED's). The image is recreated as a series of laterally offset pixels. Initially the radiation-sensitive silver halide films were essentially the same films used for radiographic imaging, except that finer silver halide grains were substituted to minimize noise (granularity). The advantages of using modified radiographic films to provide a hard copy of the digitally stored image are that medical imaging centers are already equipped to process radiographic films and are familiar with their image characteristics.

A typical film, KODAK EKTASCAN HN™, for creating a hard copy of a digitally stored medical diagnostic image includes an emulsion layer coated on a clear or blue tinted polyester film support. The emulsion layer contains a red-sensitized silver iodobromide (2.5 mol % iodide ion, based on total silver) cubic grain (0.33 μm ECD) emulsion coated at a silver coverage of 30 mg/dm$^2$. A conventional gelatin overcoat is coated over the emulsion layer. On the back side of the support a pelloid layer containing a red-absorbing antihalation dye is coated. A gelatin interlayer, used as a hardener incorporation site, overlies the pelloid layer, and a gelatin overcoat containing an antistat overlies the interlayer. Silver halide is relied upon to provide the infrared density required to activate processor sensors. No dye is introduced for the purpose of increasing infrared absorption.

It is the prevailing practice to process black and white radiographic films, including the film described above, in 90 seconds or less in an automatic process. For example, the Kodak X-OMAT 480 RA™ rapid access processor employs the following conventional processing cycle:

| | |
|---|---|
| Development | 24 seconds at 35° C. |
| Fixing | 20 seconds at 35° C. |
| Washing | 20 seconds at 35° C. |
| Drying | 20 seconds at 65° C. |

with up to 6 seconds being taken up in film transport between processing steps.

A typical developer has the following composition:

| | |
|---|---|
| Hydroquinone | 30 g |
| PHENIDONE | 1.5 g |
| KOH | 21 g |
| $NaHCO_3$ | 7.5 g |
| $K_2SO_3$ | 44.2 g |
| $Na_2S_2O_3$ | 12.6 g |
| NaBr | 35.0 g |
| 5-Methylbenzotriazole | 0.06 g |
| Glutaraldehyde | 4.9 g |
| Water to 1 liter/pH 10.0 | |

A typical fixing solution has the following composition:

| | |
|---|---|
| Ammonium thiosulfate, 58% | 260.0 g |
| Sodium bisulfite | 180.0 g |
| Boric acid | 25.0 g |
| Acetic acid | 10.0 g |
| Water to 1 liter/pH 3.9–4.5 | |

Following development and fixing, the process typically includes a washing step whereby processing chemicals are washed out of the radiographic film using water, and a drying step. The film processed in this manner is then ready for image viewing.

Radiographic film processors such as the RA 480 processor are capable of processing large amounts of film over extended periods of time (e.g., a month or more) before its processing solutions are drained and replaced. Extended use of the processing solutions is made possible by the addition of small amounts of developer and fixer replenishers as each film is processed to compensate for developer and fixer losses by evaporation and film pick up.

Current technology utilizes developer and fixing solution replenisher solutions comprising similar components and concentrations as the original developer and fixing solutions. A suitable replenishment rate allows for stable sensitometry as numerous films are processed. Without any replenishment, sensitometry eventually would become unsatisfactory (that is, loss in film speed). Yet, there is a desire in the industry to reduce replenishment rates as much as possible so the costs of processing radiographic films can be reduced, and less effluent is discharged to the environment, thereby contributing to lower health care costs and environmental concerns. This must be done, however, without sacrificing sensitometric results as important health decisions are obviously based on having accurate images in radiographic films.

Generally the replenishment rate for the radiographic film developer is about 60 ml per 238 in$^2$ (14×17 inch sheet) or per 0.154 m$^2$ (35.6×43.2 cm sheet), and the fixing solution replenishment rate is about 80 ml for the same area. With increasing pressure to reduce effluent to the environment even more, it would be desirable to reduce these rates further if possible.

Thiaalkylene bisquaternary ammonium salts have been employed for a variety of purposes in silver halide photography. They are thioethers and hence capable of acting as grain ripening agents. They have been used also in fixing solutions, and as fog reducing agents. In copending and commonly assigned U.S. Ser. No. 08/574,508, filed Dec. 19, 1995 by Dickerson et al, these salts (known as "Quadt salts") are described as being incorporated into silver bromochloride radiographic films to increase imaging speed. They can also be included in the developer or activator solutions used for processing such films. When employed in the films, the Quadt salts tend to leach out into the developer and developer pH drops because of by-products from development.

There is a need in the art for a processing method for radiographic films containing Quadt salts that uses inexpensive and effective low developer replenishment rates while maintaining desired sensitometric properties, such as photographic speed. It would also be desired to extend the life of the developer solution so that less effluent is discharged to the environment.

SUMMARY OF THE INVENTION

The problems noted above are solved with a method for providing an image in an imagewise exposed radiographic film that comprises a transparent support having disposed thereon at least one silver halide emulsion layer containing grains composed of substantially no silver iodide, and in the same or different layer, from about 0.02 to about 1 mg/dm$^2$ of a thiaalkylene bis(ammonium salt), the method comprising:

A) developing the imagewise exposed radiographic film with a developer solution having a pH of from about 9 to about 11, and comprising a silver halide developing agent in an amount of at least about 0.09 mol/l, B) adding to the developer solution, as a sole developer replenishing reagent, a chemical base in an amount and at a rate to maintain the pH of the developer solution at from about 9 to about 11 during processing of the film.

The processing method of this invention requires less developer replenishment Moreover, developer replenishment is achieved by a simple alkaline solution that comprises a chemical base as the sole developer replenishment reagent. The replenishment solution is added in an amount and at a rate that will maintain the developer solution pH at from about 9 to about 11. With this relatively simple and inexpensive means for developer replenishment, it was found surprisingly that acceptable sensitometry is achieved with the present invention. Photographic speed is not lost. The replenishment reagent(s) used in this invention is a simple chemical base. Moreover, minimal replenishment reagent(s) must be discharged to the environment, and what it discharged is relatively benign (that is, has low environmental load). Because of the type of films being processed and the simplicity of developer replenishment, the present invention enhances rapid processing of silver halide radiographic films.

DETAILED DESCRIPTION OF THE INVENTION

The following definitions are to be used in interpreting the present invention:

In referring to grains or emulsions containing two or more halides, the halides are named in order of ascending concentrations.

The "aspect ratio" of a grain is the ratio of its equivalent circular diameter (ECD) to its thickness. The ECD of a grain is the diameter of a circle having an area equal to the projected area of the grain.

The "coefficient of variation" (COV) of grain size (ECD) is defined as 100 times the standard deviation of grain size divided by mean grain size.

"Customer upper density point" (CUDP) is employed to indicate the image density measured at 0.806 Log H, that is, the maximum density that a printer can print.

The term "covering power" is used to indicate 100 times maximum density divided by silver coating coverage measured in g/dm$^2$.

The term "rapid access processor" is employed to indicate a radiographic film processor that is capable of providing dry-to-dry processing in 100 seconds or less. The term "dry-to-dry" is used to indicate the processing cycle that occurs between the time a dry, imagewise exposed element enters a processor to the time it emerges, developed, fixed and dry.

The terms "thiaalkylene bis(quaternary ammonium) salt" and "Quadt salt" is employed to describe salts containing two ammonio groups joined through a thiaalkylene linkage. Ammonio groups are those that contain at least one of the following quaternary nitrogen atoms:

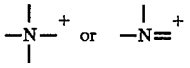

A "thiaalkylene" linkage is an alkylene linkage including at least one divalent sulfur atom replacing a carbon.

Research Disclosure is published by Kenneth Mason Publications, Ltd., Dudley House, 12 North St., Emsworth, Hampshire P010 7DQ, England.

A chemical base is defined herein conventionally (that is, it is a water-soluble proton accepting compound).

The radiographic films processed according to this invention typically comprise a transparent support having disposed on one or both sides, a silver halide (defined below) emulsion layer, and optionally one or more interlayers, subbing layers, overcoat layers, and pelloid layers.

While a support in its simplest form can consist of any flexible transparent film, it is common practice to modify the surfaces of photographic and radiographic film supports by providing subbing layers to promote the adhesion of hydrophilic colloids to the support. Although any conventional photographic film support can be employed, it is preferred to employ a radiographic film support, since this maximizes compatibility with the rapid access radiographic film processors in which the films of the invention are intended to be processed and provides a radiographic film look and feel to the processed film. Radiographic film supports usually exhibit these specific features: (1) the film support is constructed of polyesters to maximize dimensional integrity rather than employing cellulose acetate supports as are most commonly employed in photographic elements and (2) the film supports are blue tinted to contribute the blue-black image tone sought in the fully processed films. Radiographic film supports, including the incorporated blue dyes that contribute to cold image tones, are described in *Research Disclosure,* Item 18431, cited above, Section XII. Film Supports. *Research Disclosure,* Vol. 365, September 1994, Item 36544, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly(ethylene naphthenate) are specifically preferred polyester film supports.

An anticurl function can be primarily performed by the pelloid layer. The pelloid layer also provides a convenient site for dyes that are not required to interact with the emulsion layer (e.g., antihalation dyes). Surface overcoat layers are provided to enhance the physical handling characteristics of the element and to provide convenient sites for modifying addenda.

The emulsion grains of the silver halide emulsion layer have been chosen to offer a particularly advantageous combination of properties:

(1) Rapid processing, allowing compatibility with rapid access processors (including those having dry-to-dry processing in less than 40 seconds) used for radiographic films;

(2) High covering power, allowing low silver coating coverages; and (3) Enhanced image tone properties.

The silver halide emulsions useful in the practice of this invention comprise grains of silver bromide or silver chloride, or mixtures thereof. Thus, the emulsion grains can be composed of silver bromide, silver chloride, silver bromochloride or silver chlorobromide, as long as the emulsion is substantially free of silver iodide (that is, less than about 0.5 mol % silver iodide).

The properties noted above are in part achieved by choosing preferred emulsions containing silver bromochloride grains. Since the emulsions are intended to be exposed by a controlled radiation source, typically a laser, a slight increase in imaging speed that might be gained by iodide incorporation offers little or no practical benefit and is, in fact, a significant disadvantage when the reduction of development and fixing rates produced by iodide incorporation are taken into consideration.

More preferably, the grains contain at least 50 mol % silver chloride. It is known that silver chloride exhibits a higher level of solubility than other photographic halides and hence the fastest development and fixing rates.

If at least about 10 mol % bromide, based on total silver, is incorporated into the emulsion grains, covering power is increased to approximately the higher covering power levels of silver bromide, most commonly used in radiographic films. Thus, the grains most preferably contain from about 20 to 40 mol % bromide, based on total silver contained in the grains.

In addition to selecting the halide composition of the grains, it is contemplated to limit the average ECD of the grains to less than 0.40 μm. Preferably the emulsions are fine grain emulsions having mean grain ECD's in the range of from about 0.05 to 0.4 μm. For such fine grain emulsions, nontabular grain populations are preferred. The average aspect ratio of a cubic grain emulsion is about 1.1. Average aspect ratios of less than 1.3 are contemplated. The nontabular grains can take any convenient conventional shape consistent with the stated average aspect ratio. The grains can take regular shapes, such as cubic, octahedral or cuboctahedral (i.e., tetradecahedral) grains, or the grains can take other shapes attributable to ripening, twinning, screw dislocations, etc. Preferred grains are cubic grains bounded primarily by {100} crystal faces, since {100} grain faces are exceptionally stable.

The fine grain emulsions described herein offer a relatively high ratio of surface area to grain volume and hence are particularly suited for rapid access processing. A common alternative approach for achieving high surface area to volume grain ratios is to employ a thin or high average aspect ratio tabular grain emulsion. Specifically, in the preferred emulsions, the COV of the emulsions is less than 20 percent and, optimally, less than 10 percent.

The high covering power of the silver halide (preferably silver chlorobromide) grains allows coating coverages to be maintained at less than 40 (preferably less than 30) mg/dm$^2$, based on silver. Coating coverages for highly monodisperse emulsions as low as about 10 (preferably about 15) mg/dm$^2$ are contemplated.

The silver halide emulsions can be selected from among conventional emulsions, as defined above. A general description of silver halide emulsions can be found in *Research Disclosure,* Item 36544, Section I. Emulsion grains and their preparation. The most highly monodisperse (lowest COV) emulsions are those prepared by a batch double-jet precipitation process. Specific examples of these emulsions are provided U.S. Pat. No. 4,865,962 (Hasebe et al), U.S. Pat. No. 5,252,454 (Suzumoto et al), and U.S. Pat. No. 5,252,456 (Oshima et al), the disclosures of which are here incorporated by reference. The silver bromochloride grains of conventional high chloride emulsions intended for graphic arts applications are also well suited for use in the present invention. Generally any convenient distribution of bromide and chloride ions within the grains can be employed. It is generally preferred, based on convenience of preparation, to distribute bromide uniformly within the grains. Alternatively, silver bromide can be epitaxially deposited onto host grains containing lower levels of silver bromide (e.g., silver chloride host grains). The latter has the advantage of allowing the silver bromide epitaxy to act as a sensitizer.

In the course of grain precipitation one or more dopants (grain occlusions other than silver and halide) can be introduced to modify grain properties. For example, any of the various conventional dopants disclosed in *Research Disclosure,* Item 36544, Section I. Emulsion grains and their preparation, sub-section G. Grain modifying conditions and adjustments, paragraphs (3), (4) and (5), can be present in the emulsions. In addition, it is specifically contemplated to dope the grains with transition metal hexacoordination complexes containing one or more organic ligands, as taught by U.S. Pat. No. 5,360,712 (Olm et al), the disclosure of which is here incorporated by reference. Dopants for increasing imaging speed by providing shallow electron trapping sites (i.e., SET dopants) are the specific subject matter of *Research Disclosure,* Vol. 367, November 1994, Item 36736.

Since the controlled radiation sources used to reproduce digitally stored images frequently employ short ($<10^{-1}$ second) exposure times and laser exposures in fractional microseconds are common, it is specifically contemplated to reduce high intensity reciprocity failure (HIRF) by the incorporation of iridium as a dopant. To be effective for reciprocity improvement the Ir must be incorporated within the grain structure. To insure total incorporation it is preferred that Ir dopant introduction be complete by the time 99 percent of the total silver has been precipitated. Specific illustrations of useful Ir dopants contemplated for reciprocity failure reduction are provided by B. H. Carroll, "Iridium Sensitization: A Literature Review", *Photographic Science and Engineering,* Vol. 24, No. 6 November/December 1980, pp. 265–267; U.S. Pat. No. 3,901,711 (Iwaosa et al); U.S. Pat. No. 4,828,962 (Grzeskowiak et al); U.S. Pat. No. 4,997,751 (Kim); U.S. Pat. No. 5,134,060 (Maekawa et al); U.S. Pat. No. 5,164,292 (Kawai et al); and U.S. Pat. Nos. 5,166,044 and 5,204,234 (both Asami).

The contrast of the silver halide emulsions described herein can be increased by doping the grains, in any convenient location, with a hexacoordination complex containing a nitrosyl (NO) or thionitrosyl (NS) ligand. Preferred coordination complexes of this type are disclosed by U.S. Pat. No. 4,933,272 (McDugle et al), the disclosure of which is here incorporated by reference.

The emulsions can be chemically sensitized by any convenient conventional technique. Such techniques are illustrated by *Research Disclosure,* Item 36544, Section IV. Chemical sensitization. Sulfur and gold sensitizations are specifically contemplated.

Since silver halide emulsions as described herein possess little native sensitivity beyond the ultraviolet region of the spectrum and controlled radiation sources used for exposure, such as lasers and LED's, are most readily constructed to provide exposures in the longer wavelength portions of the visible spectrum (e.g., longer than 550 nm) as well as the near infrared, it is specifically contemplated that one or more spectral sensitizing dyes will be absorbed to the surfaces of the silver chlorobromide grains. Ideally the maximum absorption of the spectral sensitizing dye is matched (e.g., within ±10 nm) to the exposure wavelength of the controlled exposure source. In practice any spectral sensitizing dye can be employed which, as coated, exhibits a half peak absorption bandwidth that overlaps the spectral region of exposure by the controlled exposure source.

A wide variety of conventional spectral sensitizing dyes are known having absorption maxima extending throughout the visible and near infrared regions of the spectrum. Specific illustrations of conventional spectral sensitizing dyes is provided by *Research Disclosure*, Item 18431, Section X. Spectral Sensitization, and Item 36544, Section V. Spectral sensitization and desensitization, A. Sensitizing dyes.

An infrared opacifying dye can be located within the element at any convenient location. It can be incorporated in the support or in one or both of the subbing layers, coated on the support in any one or combination of the processing solution permeable layers. The preferred location for the infrared opacifying dye is in the pelloid layer.

Dyes in the cyanine dye class are preferred infrared opacifying dyes. Tricarbocyanine, tetracarbocyanine and pentacarbocyanine dyes are illustrated by U.S. Pat. No. 4,619,892 (Simpson et al), U.S. Pat. Nos. 4,871,656, 4,975,362, 5,061,618 and 5,108,882 (Parton et al), U.S. Pat. No. 4,988,615 (Davies et al), U.S. Pat. No. 5,009,992 (Friedrich et al), 5,013,642 (Muenter et al), and Hamer *The Cyanine Dyes and Related Compounds,* Interscience, 1964, Chapters VIII and IX.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 36544, Section VII. Antifoggants and stabilizers, and Item 18431, Section II. Emulsion Stabilizers, Antifoggants and Antikinking Agents.

The silver halide emulsion and other layers on opposite sides of the support additionally contain conventional hydrophilic colloid vehicles (peptizers and binders), typically gelatin or a gelatin derivative. Conventional vehicles and related layer features are disclosed in *Research Disclosure,* Item 36544, Section II. Vehicles, vehicle extenders, vehicle-like addenda and vehicle related addenda. The emulsions themselves can contain peptizers of the type set out in Section II above, paragraph A. The hydrophilic colloid peptizers are also useful as binders and hence are commonly present in much higher concentrations than required to perform the peptizing function alone. The vehicle extends also to materials that are not themselves useful as peptizers. Such materials are described in Section II, paragraph B.

The elements are fully forehardened to facilitate rapid access processing using conventional hardeners, as described in Section II, above.

Surface protective overcoats are typically provided for physical protection of the emulsion and pelloid layers. In addition to vehicle features discussed above the overcoats can contain various addenda to modify the physical properties of the overcoats. Such addenda are illustrated by *Research Disclosure,* Item 36544, Section IX. The interlayers are typically thin hydrophilic colloid layers that provide a separation between the emulsion or pelloid (particularly the former) and the surface overcoat addenda. It is quite common to locate surface overcoat addenda, particularly anti-matte particles, in the interlayers.

An increase in imaging speed can be realized by incorporating a thiaalkylene bis(quaternary ammonium) salt in at least one layer of the film. The Quadt salt acts as a development accelerator and hence its activity is dependent upon being present within the emulsion layer during development.

A preferred location of the thiaalkylene bis(quaternary ammonium) salt is in a layer on the side of the element comprising the emulsion layer. Processing solution permeates this entire layer unit during development and hence the thiaalkylene bis(quaternary ammonium) salt diffuses into the emulsion layer if it is not initially coated directly within the emulsion layer. Useful thiaalkylene bis(quaternary ammonium) salt concentrations in the layer of the element are contemplated to range from 0.02 to 1.0 mg/dm$^2$, preferably from 0.05 to 0.6 mg/dm$^2$.

When the thiaalkylene bis(quaternary ammonium) salt is incorporated in a layer unit on the back side of the support, it is necessary that the salt diffuse from the back side layer unit into the developer and then into the emulsion layer. In this instance somewhat higher concentrations are required than when the salt is incorporated in a layer on the front side.

In a preferred form the thiaalkylene bis(quaternary ammonium) salt satisfies the formula:

$$Q^1—[(CH_2)_n—S—]_m—(CH_2)_p—Q^2\ X \qquad \text{(III)}$$

where m is an integer of from 1 to 3, n and p are independently integers of from 1 to 6, $Q^1$ and $Q^2$ are ammonio groups, and X represents the ion or ions necessary to provide charge neutrality.

Typical ammonio groups include simple acyclic groups, such as illustrated by the formula:

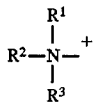

where $R^1$, $R^2$ and $R^3$ are independent hydrocarbon groups each containing from 1 to 10 (preferably 1 to 6) carbon atoms. To facilitate solubility and mobility in processing solutions it is preferred to limit the number of carbon atoms or to substitute the hydrocarbon atoms with polar substituents, such as carboxy, sulfonyl, carbamoyl, amido, sulfamoyl or sulfonamido groups. Preferred hydrocarbon groups are phenyl, alkylphenyl, phenylalkyl and alkyl groups. It is specifically preferred to limit the total number of carbon atoms in any one ammonio group to 10 or less.

In an alternative preferred form $R^1$ and $R^2$ can together complete a membered ring. Where $R^1$ and $R^2$ together form an alkylene group, typically the alkylene group contains from 4 to 10 carbon atoms. In most instances $R^1$ and $R^2$ are chosen to complete a 5 or 6 membered ring. For example, $R^1$ and $R^2$ can together complete an N—$R^3$-pyrrolio, N—$R^3$-pyrrolinio, N—$R^3$-pyrazinio, N—$R^3$-morpholinio, N—$R^3$-piperidinio or N—$R^3$-piperazinio ring.

It is specifically contemplated to employ ammonio groups illustrated by the following formula:

$$R^4-\overset{|}{\underset{+}{N}}=R^5 \quad \text{(V)}$$

where $R^4$ and $R^5$ together complete a five or six membered ring. For example, the ammonio group can be an N-2H-pyrroleninio or N-pyridinio group.

In heterocyclic ammonio groups and particularly aromatic heterocylic ammonio groups it is not necessary that the point of attachment to the linking thiaalkylene group be at the site of the quaternized nitrogen atom. From example, ammonio groups such as 4-(N-methylpyrindinio) and N'-(N-methylpyrazinio) ammonio groups are specifically contemplated.

The charge balancing counterions can be chosen from any of the anions commonly found in silver halide emulsion layers, including halide ions (e.g., fluoride, chloride, bromide), hydroxide, phosphate, sulfate, nitrate, tetrafluoroborate, p-toluenesulfonate, and perchlorate. Anions compatible with silver halide emulsions can be used interchangeably without affecting the activity of the development accelerator.

The following are illustrations of specific thiaalkylene bis(quaternary ammonium) salts:

| | |
|---|---|
| Q-1 | N,N'-[1,8-(3,6-dithiaoctylene)]bis(1-methylpiperidinium) ρ-toluenesulfonate; |
| Q-2 | N,N'-[1,10-(3,8-dithiadecylene)]bis(1-methylpiperidinium) ρ-toluenesulfonate; |
| Q-3 | N,N'-[1,12-(3,10-dithiadodecylene)]bis(1-methylpiperidinium) ρ-toluenesulfonate; |
| Q-4 | N,N'-[1,8-(3,6-dithiaoctylene)]bis(1-methylmorpholinium) ρ-toluenesulfonate; |
| Q-5 | N,N'-[1,8-(3,6-dithiaoctylene)]bis(trimethylammonium) ρ-toluenesulfonate; |
| Q-6 | N,N'-[1,8-(3,6-dithiaoctylene)]bis(diethylmethylammonium) ρ-toluenesulfonate; |
| Q-7 | N,N'-[1,8-(3,6-dithiaoctylene)]bis(1,7-heptylenemethylammonium) ρ-toluenesulfonate; |
| Q-8 | N,N'-[1,8-(3,6-dithiaoctylene)]bispyridinium tetrafluoroborate; |
| Q-9 | N,N'-[1,8-(3,6-dithiaoctylene)]bis(4-dimethylaminopyridinium) bromide; |
| Q-10 | N,N'-[1,8-(3,6-dithiaoctylene)]bis(3-formylpyridinium) bromide; |
| Q-11 | N,N'-[1,8-(3,6-dithiaoctylene)]bis(4-methylpyridinium) bromide; |
| Q-12 | N,N'-[1,8-(3,6-dithiaoctylene)]bis[3-(4-methylphenylsulfonamido)pyridinium] bromide; |
| Q-13 | N,N'-[1,8-(3,6-dithiaoctylene)]bis[4-(5-nonyl)pyridinium) bromide; |
| Q-14 | N,N'-[1,8-(3,6-dithiaoctylene)]bis(3-pentamido)pyridinium) bromide; |
| Q-15 | N,N'-[1,8-(3,6-dithiaoctylene)]bis(3-propylcarbamoyl)pyridinium) bromide; |
| Q-16 | N,N'-[1,8-(3,6-dithiaoctylene)]bis(1-methylmorpholinium) ρ-toluenesulfonate; |
| Q-17 | N,N'-[1,13-(2,12-dihydroxy-3,6-dithiatridecylene)]bis(trimethylammonium) ρ-toluenesulfonate; |

-continued

| | |
|---|---|
| Q-18 | N,N'-[1,13-(2,12-dihydroxy-3,6-dithiatridecylene)]bis(dibutylmethylammonium) ρ-toluenesulfonate; |
| Q-19 | 4,4'-[1,11-(3,6,9-trithiaundecyl)]bis(N-methylpyridinium) ρ-toluenesulfonate; |
| Q-20 | N,N'-[1,11-(3,6,9-trithiaundecyl)]bis[4-(dimethylamino)pyridinium) bromide; |
| Q-21 | 4,4'-[1,8-(3,6-dithiaoctyl)]bis(N-methylpyridinium) perchlorate; |
| Q-22 | 2,2'-[1,8-(3,6-dithiaoctyl)]bis(N-methylpyridinium) perchlorate; |
| Q-23 | N,N'-[1,19-(7,13-dithianonadecyl)]bis(2-methylpyridinium) ρ-toluenesulfonate; |

Either or both of the hydrophilic colloid layer units coated on the front and back sides of the support, but most preferably the hydrophilic colloid layer unit containing the emulsion layer, can contain one or more developing agents. It is generally known that developing agents can be incorporated in a photographic or radiographic element and that development can be initiated by bringing the element into contact with an activator solution—that is, a solution otherwise similar to a developer, but lacking a developing agent. The problem that has previously been encountered in relying entirely on the element to supply the developing agent is that 1 equivalent of developing agent is required per mole of silver halide. Such large quantities of incorporated developing agent degrade the physical handling properties of a conventional element.

In the present invention the limited concentrations of silver (<40 mg/dm$^2$) allow proportionately lower developing agent concentrations and hence reduce the negative impact of incorporated developing agent on the physical handling properties of the elements of the invention. The use of a thiaalkylene bis(ammonium) salt of the type described above also allows the levels of incorporated developing agent to be reduced. It is also contemplated to employ, either incorporated in the film or in solution, a supplemental developing agent that is capable of reducing the incorporation of developing agent below 1 equivalent, preferably to 0.5 equivalent or less, and thereby allowing the restricted concentration of developing agent to reduce larger amounts of silver halide than would be otherwise possible.

Alternatively or additionally, the developing agent can be used in a conventional developer composition in conventional amounts.

When incorporated in the film, or in the developer solution, the developing agents and supplemental developing agents can be of any conventional type, but are preferably of the types customarily used with rapid access processors. Preferred developing agents are hydroquinones. The following are illustrations of typical hydroquinone developing agents:

| | |
|---|---|
| HQ-1 | Hydroquinone; |
| HQ-2 | Methylhydroquinone; |
| HQ-3 | 2,6-Dimethylhydroquinone; |
| HQ-4 | Chlorohydroquinone; |
| HQ-5 | 2-Methyl-3-chlorohydroquinone; |
| HQ-6 | Dichlorohydroquinone; |
| HQ-7 | Bromohydroquinone; |
| HQ-9 | Hydroxyhydroquinone; |
| HQ-10 | Potassium hydroquinone sulfonate. |

Ascorbic acid or suitable salts thereof can also be used as developing agents in the practice of this invention.

The supplemental developing agents are most typically p-aminophenols, p-phenylenediamines, reductones or 3-pyrazolidinones, with the latter being most widely used in rapid access processing. The following are specific illustrations of supplemental developing agents:

| | |
|---|---|
| SDA-1 | ρ-Aminophenol; |
| SDA-2 | ρ-Methylaminophenol; |
| SDA-3 | ρ-Ethylaminophenol; |
| SDA-4 | ρ-Dimethylaminophenol; |
| SDA-5 | ρ-Dibutylaminophenol; |
| SDA-6 | ρ-Piperidinophenol; |
| SDA-7 | 4-Dimethylamino-2,6-dimethoxyphenol; |
| SDA-8 | N-Methyl-ρ-phenylenediamine; |
| SDA-9 | N-Ethyl-ρ-phenylenediamine; |
| SDA-10 | N,N-Dimethyl-ρ-phenylenediamine; |
| SDA-11 | N,N-Diethyl-ρ-phenylenediamine; |
| SDA-12 | N,N,N',N'-Tetramethyl-ρ-phenylenediamine; |
| SDA-13 | 4-Diethylamino-2,6-dimethoxyaniline; |
| SDA-14 | Piperidino-hexose-reductone; |
| SDA-15 | Pyrrolidino-hexose-reductone; |
| SDA-16 | 1-Phenyl-3-pyrazolidinone; |
| SDA-17 | 4,4-Dimethyl-1-phenyl-3-pyrazolidinone; |
| SDA-18 | 4-Hydroxymethyl-4-methyl-1-phenyl-3-pyrazolidinone; |
| SDA-19 | 4,4-Bis(hydroxyethyl)-1-phenyl-3-pyrazolidinone; |
| SDA-20 | 4,4-Dimethyl-1-tolyl-3-pyrazolidinone; |
| SDA-21 | 4,4-Dimethyl-1-xylyl-3-pyrazolidinone; |
| SDA-22 | 1,5-Diphenyl-3-pyrazolidinone. |

The developer composition can include other reagents that conventionally included therein such as buffers (such as carbonate, phosphate or borate), halides (such as chloride or bromide ions), chemical bases (such as a hydroxide), amines and sequestering agents. The amounts of such components are conventional in the art. The pH of the developer compositions is generally from about 9 to about 11, and a pH of from about 9.5 to about 10.5 being preferred and a pH of from about 9.8 to about 10.5 being more preferred.

A preferred developer is the commercially available RP X-OMAT™ developer (Eastman Kodak Company).

Development of the radiographic film is generally carried out for less than about 50 seconds at a temperature of from about 30° to about 40° C. Preferably, the film is processed for from about 5 to about 25 seconds at a temperature of from about 32° to about 38° C. In most instances, the film is a sheet rather than a continuous element. Thus, each sheet is placed in the processor and bathed in the developer composition for a desired time.

In the course of the present invention, the developer composition pH has a tendency to drop because of by-products from development. In conventional processing methods, the developer composition must be replenished with a developer replenisher that has essentially the same composition as the original developer composition. However, with the present invention, the developer composition can be replenished solely with a chemical base, either in solid or liquid form, or in an aqueous solution. This chemical base raises the pH of the developer composition and maintains its activity. It has been found that as many as 1000 radiographic film sheets can be suitably processed with a single original developer composition bath if it is replenished with a chemical base at suitable times during processing.

Suitable chemical bases that can be used as the sole replenishing reagent in this invention include, but are not limited to, carbonates, phosphates, amines (such as glycine), borates and hydroxides. Carbonates and phosphates are preferred, and carbonates (such as potassium carbonate) are most preferred. Mixtures of these chemical bases can be used if desired.

While the chemical bases can be added as replenishing reagents in solid or liquid form directly to the developer composition, it is preferred that they be added as aqueous solutions. In such instances, the concentration of the chemical base is at least about 0.5 mol/l, and a concentration of from about 2 to about 10 mol/l is preferred.

When an aqueous replenisher solution is used, it is used at a replenishing rate of less than about 4 ml/dm$^2$, and preferably, at a rate of from about 0.1 to about 0.5 ml/dm$^2$, of processed radiographic film. In the case of processing the sheets noted above (14×17 inches), replenishment is generally less than 5 ml/sheet when an aqueous solution of potassium carbonate (47%) is used as the replenisher solution.

Following development, the radiographic films are then fixed using conventional fixing solutions containing conventional fixing agents in conventional amounts. Fixing times, temperatures and replenishment rates are also conventional.

Washing of the fixed films can then be carried out using conventional procedures and washing solutions (usually water). Intermediate steps in the process can include washing between the development and fixing steps.

Conventional processing of radiographic films described herein is carried out by manually or automatically placing the imagewise exposed film into an automatic processor. The film then is passed through the various processing solutions by transport rollers. The developer and fixing solution are generally replenished by providing the replenishing solutions to the respective processing tanks using suitable means.

The invention can be better appreciated by reference to the following specific embodiments. All coating coverages, indicated parenthetically, are in mg/dm$^2$, except as otherwise indicated. Silver halide coating coverages are reported in terms of silver. All other percentages are by weight, unless otherwise indicated. The example is not meant to be limiting, but to exemplify the best way of carrying out the invention.

EXAMPLE

Two radiographic elements of the following layer arrangement were provided, but with differing silver halide grain compositions. The elements were constructed for exposure using a helium-neon 670 nm laser. Element A had the following construction and components:

| |
|---|
| Surface Overcoat |
| Interlayer |
| Silver Halide Emulsion Layer |
| Subbing Layer |
| Transparent Film Support |
| Subbing Layer |
| Pelloid Layer |
| Interlayer |
| Surface Overcoat |

Film Support

The film support was a conventional blue-tinted 7 mil (177.8 mm) transparent poly(ethylene terephthalate) radiographic film support.

Pelloid Layer

The pelloid contained gelatin (25.1) and the antihalation dyes bis[3-methyl-1-(p-sulfophenyl)-2-pyrazolin-5-one-(4)] pentamethineoxonol (0.96) and 1,4-benzene sulfonic acid, 2-[3-acetyl-4-{5-[3-acetyl-1-(2,5-disulfophenyl)-1,5-dihydro-5-oxo-4H-pyrazol-4-yl-idene]-1,3-pentadienyl}-5-hydroxy-1H-pyrazol-1-yl]pentasodium salt (1.74).

Surface Overcoats

The surface overcoats each contained gelatin (4.5), matte beads (0.2) and silicone lubricant (0.14).

Interlayers

The interlayers each contained gelatin (4.5).

Silver Halide Emulsion Layer

The silver halide emulsion layer contained a silver bromochloride emulsion comprised of sulfur and gold sensitized silver halide cubic grains (20.2) optimally spectrally sensitized with anhydro-9-ethyl-3,3'-bis(3-sulfopropyl)-4,5,4',5'-dibenzothiacarbocyanine hydroxide, sodium salt; gelatin (21.8); 4-hydroxy-6-methyl-2-methylmercapto-1,3,3A-tetraazaindene (3 g/Ag M); resorcinol (1.0), N,N'-[1,8-(3,6-dithiaoctylene)]bis(1-methylpiperidinium) p-toluenesulfonate (0.22), and sodium disulfocatechol (0.2).

Element A, containing grains of silver bromochloride (30:70 molar halide ratio) and having an ECD of 0.23 μm, is an element within the scope of the present invention. Element B, containing grains of silver iodobromide (2.5:97.5 molar halide ratio) and having an ECD of 0.33 μm, is an element outside the scope of the present invention. Element B is commercially available as KODAK EKTASCAN HN™ Radiographic Film.

All of the gelatin-containing layers were fully forehardened using 2.4 wt % bis(vinylsulfonylmethyl)ether, based on the weight of gelatin.

Up to 600 sheets (14×17 inches) of each element was imagewise exposed using a helium-neon laser emitting at 670 nm. The sheets were then processed in a conventional Kodak X-OMAT 480 RA™ processor, using the conventional developer (RP X-OMAT™ developer) at 35° C. for 24 seconds, conventional fixer (RP X-OMAT™ Fixer and Replenisher) at 35° C. for 20 seconds, and washing (water) at 22° C. for 20 seconds, followed by drying.

In one processing method (Control A), sheets of Element B were processed using a developer replenishment rate of 65 ml/sheet, using the conventional developer solution as the replenisher. In a second processing method (Control B), sheets of the same element were processed without developer replenishment.

In the method of the present invention, sheets of Element A were processed by replenishing the developer with an aqueous solution (47%) of potassium carbonate. The pH of the developer was thereby maintained at from 9.9–10.0 using a replenishment rate of 5 ml/sheet.

The following TABLE I shows the results of each processing method (both Controls A and B and the Invention). Specifically, listed in TABLE I are the speed number (1.0 "CR") and "customer upper density point" (CUDP) evident after processing various numbers of sheets using each of the noted methods. It is apparent that the Control A processing method provided acceptable sensitometry with the silver iodobromide-containing elements, but comparing it to the Control B method, it is also apparent that acceptable sensitometry required a high developer replenishment rate with the conventional developer formulation.

In contrast, the Invention provided acceptable sensitometry with a much lower developer replenishment rate, and the replenishing solution was merely an aqueous alkaline buffer solution. This represents a considerable and unexpected improvement for processing radiographic films.

TABLE I

| Number Of processed | Element B Control A | | Element B Control B | | Element A Invention | |
|---|---|---|---|---|---|---|
| sheets | 1.0 CR | CUDP | 1.0 CR | CUDP | 1.0 CR | CUDP |
| 0 | 293 | 2.86 | 291 | 2.80 | 262 | 2.38 |
| 200 | — | — | 293 | 2.72 | 264 | 2.41 |
| 300 | 297 | 2.90 | 290 | 2.54 | 262 | 2.33 |
| 400 | — | — | 281 | 2.23 | 263 | 2.37 |
| 600 | 296 | 2.85 | — | — | 263 | 2.35 |

The invention has been described in detail with particular reference to preferred embodiments thereof, but it will be understood that variations and modifications can be effected within the spirit and scope of the invention.

We claim:

1. A method for providing an image in an imagewise exposed radiographic film that comprises a transparent support having disposed thereon at least one silver halide emulsion layer containing grains composed of substantially no silver iodide, and in the same or different layer, from about 0.02 to about 1 mg/dm$^2$ of a thiaalkylene bis (ammonium salt), said method comprising:

A) developing said imagewise exposed radiographic film with a developer solution having a pH of from about 9 to about 11, and comprising a silver halide developing agent in an amount of at least about 0.09 mol/l, B) adding to said developer solution, as a sole developer replenishing reagent, a chemical base in an amount and at a rate to maintain the pH of said developer solution at from about 9 to about 11 during processing of said film.

2. The method of claim 1 wherein an aqueous replenisher solution is added to said developer solution at a rate of less than about 4 ml/dm$^2$ of processed film, said chemical base being present in said replenisher solution in an amount of at least about 0.5 mol/l.

3. The method of claim 1 wherein said silver halide emulsion grains comprise at least 50 mol % silver chloride.

4. The method of claim 1 wherein said chemical base is a carbonate, phosphate, borate, amine or hydroxide.

5. The method of claim 1 wherein said developer solution pH is maintained at from about 9.8 to about 10.5.

6. The method of claim 1 carried out within about 100 seconds.

7. The method of claim 1 wherein said thiaalkene bis (ammonium salt) is located in said silver halide emulsion layer.

8. The method of claim 1 wherein said thiaalkylene bis(ammonium salt) is present in said element in an amount of from about 0.05 to about 0.6 mg/dm$^2$.

9. The method of claim 1 wherein said thiaalkylene bis(ammonium salt) is represented by the formula:

$$Q^1—[(CH_2)_n—S—]_m—(CH_2)_p—Q^2\ X$$

wherein $Q^1$ and $Q^2$ are independently ammonio groups, X represents one or more ions necessary to provide charge neutrality in the molecule, m is an integer of 1 to 3, and n and p are independently integers of 1 to 6.

10. The method of claim 1 wherein said silver halide developing agent is a hydroquinone or ascorbic acid.

11. The method of claim 1 wherein said film further includes a black and white silver halide developing agent.

12. The method of claim 1 wherein said silver halide emulsion comprises silver bromochloride grains having at least about 10 mol % silver bromide.

13. The method of claim 12 wherein said silver bromochloride grains contain from about 20 to about 40 mol % silver bromide.

14. The method of claim 1 wherein said silver halide grains have an average aspect ratio of less than about 1.3, and a mean equivalent circular diameter of less than about 0.4 μm.

15. The method of claim 1 wherein said film has a silver halide emulsion layer on both sides of said transparent support.

16. The method of claim 1 wherein said silver halide emulsion layer is coated at a silver coverage of less than about 40 $mg/dm^2$.

17. The method of claim 1 wherein said silver halide grains exhibit a coefficient of variation of grain size of less than about 20%.

18. The method of claim 1 wherein said thiaalkylene bis(ammonium salt) is N,N'-[1,8-(3-6-dithiaoctylene)]bis(1-methylpiperidinium) p-toluenesulfonate, said silver halide emulsion comprises from about 20 to about 40 mol % silver bromide, and said chemical base is a carbonate in an aqueous replenisher solution at a concentration of at least about 0.5 mol/l.

19. The method of claim 18 wherein said replenisher solution is used at a replenishment rate of less than about 4 $ml/dm^2$.

20. The method of claim 1 wherein said replenisher solution is used at a replenishment rate of from about 0.1 to about 0.5 $ml/dm^2$.

* * * * *